US005318348A

United States Patent [19]

Hess

[11] Patent Number: 5,318,348

[45] Date of Patent: Jun. 7, 1994

[54] CUSHIONED SLING CHAIR

[75] Inventor: Stephen C. Hess, Birmingham, Ala.

[73] Assignee: Winston Furniture Company, Inc., Birmingham, Ala.

[21] Appl. No.: 794,068

[22] Filed: Nov. 19, 1991

[51] Int. Cl.[5] ..... A47C 7/00

[52] U.S. Cl. ..... 297/440.11; 297/452.16

[58] Field of Search ..... 297/440.1, 440.11, 218, 297/226, 219.1, 452.1, 452.11, 452.16, 445, 446, 447, 452.12; 5/402, 407, 122, 406, 470, 653, 471, 448, 420, 401

[56] References Cited

U.S. PATENT DOCUMENTS

| | | | |
|---|---|---|---|
| 1,727,529 | 9/1929 | Van Hove | 5/407 |
| 2,582,864 | 1/1952 | Gittings et al. . | |
| 2,738,835 | 3/1956 | Eames . | |
| 3,024,068 | 3/1962 | Eames | 297/441 X |
| 3,379,474 | 4/1968 | Schwarz, Jr. | 297/441 X |
| 3,671,984 | 6/1972 | Ambrose | 5/402 |
| 3,677,601 | 7/1972 | Morrison et al. | 297/441 |
| 3,977,721 | 8/1976 | Peterson | 297/45 |
| 4,357,723 | 11/1982 | Zelkowitz | 5/403 |
| 4,370,002 | 1/1983 | Koepke | 297/452 |
| 4,432,521 | 2/1984 | Douglas | 248/176 |
| 4,482,186 | 11/1984 | Gomes | 297/441 |
| 4,518,202 | 5/1985 | Bitsch | 297/445 X |
| 4,542,938 | 9/1985 | Tisbo et al. | 297/445 |
| 4,709,431 | 12/1987 | Shaktman | 5/653 X |
| 4,761,035 | 8/1988 | Urai | 297/452 |
| 4,782,540 | 11/1988 | Parker | 5/471 |
| 4,801,482 | 1/1989 | Goggans et al. | 428/68 |
| 4,848,843 | 7/1989 | Gibbs | 297/440 |
| 4,914,772 | 4/1990 | Difloe | 297/452 X |
| 4,943,478 | 7/1990 | McCullough, Jr. et al. | 428/288 |

*Primary Examiner*—Kenneth J. Dorner
*Assistant Examiner*—Milton Nelson, Jr.
*Attorney, Agent, or Firm*—Bell, Seltzer, Park & Gibson

[57] ABSTRACT

A chair having a skeletal frame and a pliable seat and backrest having first and second superposed and interconnected fabrics. The first and second fabrics have looped fabric portions that define opposite side edges of the fabrics. Each of the looped fabric portions in the first fabric contains an elongate flexible member. The skeletal frame has a pair of elongate members that support the seat and backrest. The elongate members on the chair frame have lengthwise extending passageways and longitudinal slots for receiving the looped fabric portions of the first fabric and the elongate flexible members to secure the seat and backrest to the chair frame. The looped fabric portions of the second fabric overlie the elongate members and looped fabric portions of the first fabric to enhance the appearance of the chair. The first fabric substantially supports the tensile forces imposed on the seat and backrest by the weight of a person seated in the chair. The second fabric may be decorated with a printed pattern.

19 Claims, 2 Drawing Sheets

CUSHIONED SLING CHAIR

FIELD OF THE INVENTION

The present invention relates to sling chairs of the type having a seat and backrest made of a webbed material stretched across a rigid skeletal frame. In particular, the invention relates to chairs having a cushioned seat and backrest.

BACKGROUND OF THE INVENTION

Chairs of the type generally intended for recreational or outdoor use may be made in many different styles using a variety of materials designed to withstand the rigors of such use. Often, these chairs have skeletal frames made of metal tubing, wood, plastic or some other rigid material that can endure the hardships of prolonged exposure to weather and which is durable enough to withstand relatively heavy use. It is also generally desirable that the chair frame be lightweight for easy mobility, yet it must have sufficient rigidity to support the weight of a seated person.

The skeletal chair frame generally defines and supports a seat and backrest that is made of a material adapted to provide a comfortable seating area. Unfortunately, many materials that are well suited for providing a comfortable seating area and which would render adequate service if used in indoor conditions are prone to rapid deterioration from prolonged exposure to ambient conditions. For example, sunlight may cause degradation of some synthetic materials such as vinyl or other plastics, causing them to lose their strength and appearance. Moisture from precipitation or high humidity may cause rot or may promote mildew. Wide daily and seasonal temperature swings cause expansion and contraction of the materials, and freezing temperatures may cause further damage from ice formation.

Prior to the present invention, recreational seating has generally been fabricated in three primary styles which are capable of withstanding the severe demands described above. Many chairs have a seat and backrest formed of multiple straps of material that are stretched laterally across the chair frame. Chairs of this type are colloquially known in the industry as "strap chairs." The strap material used to form the seat of these chairs may be made of solid lengths of pliable vinyl or of relatively narrow segments of webbed material woven from synthetic fibers. Strap chairs have a distinctive appearance due to the plurality of straps extending across the frame and the interstices left open between adjacent straps. Although strap chairs are generally durable, inexpensive to manufacture and light in weight, the seat and backrest cannot readily be decorated with a unitary design as the successive straps are distinct from each other.

A second type of chair uses cushions as the seat and backrest. Chairs of this sort are generally known as "cushion chairs." These cushions are of a conventional type having an outer shell made of a woven or sheet material that surrounds an interior layer of padding material. One cushion may be used as the seat and another cushion as the backrest, or a single cushion may be used as both the seat and backrest.

The cushions are supported from beneath by the chair frame, which must have straps, metal plates, bars or the like extending beneath the seat and behind the backrest to support the cushion. Usually, the cushion rests independently on the chair frame and can be easily removed from the frame for storage inside. Because the padding material is encased within a layer of sheet or woven material, cushions are readily adapted for surface decoration. However, cushion chairs are generally heavier and more expensive to manufacture than strap chairs due to the more complex frame construction necessary to underlie the cushion.

A third type of recreational seating is known as the "sling chair." Sling chairs have a skeletal frame that is commonly made of extruded metal tubing that is assembled into a rigid frame that defines the lateral edges of a seating area. Sections of tubing having channels formed therein are positioned along the lateral sides of the seating area, generally within the exterior confines of the frame. In sling chairs, the seat and backrest are formed by a relatively heavy web of material that is tautly stretched across the lateral sides of the frame. Generally, the lateral edges of the webbed sling material are securely fastened to the chair frame by means of acrylic rods held within hemmed pockets formed in the edges of the sling material. These rods and the hemmed portions containing them are retained within the channels formed by the tubing.

Sling seats have an attractive, modern appearance, are lightweight and may be relatively inexpensive to construct. However, because the sling seating must withstand relatively high tensile forces in order to support the weight of a person seated in the chair, the sling fabric is generally made of a relatively heavy woven material. The sling fabric must also withstand prolonged expose to outdoor conditions. Commonly, the material of choice is a relatively rough weave of vinyl or a blend of vinyl and acrylic monofilament fibers. These fabrics are not readily susceptible to application of pleasing printed designs such as a floral pattern or the like. Sling seating has a relatively rough surface and lacks any cushioning material to enhance the comfort of a person seated on the chair. Also, the joinder of the seat and backrest fabric and the chair frame is readily visible and may present an unfinished appearance.

In light of the aforementioned deficiencies, it is an object of the present invention to provide a new sling chair that has a smooth seating surface which may be imprinted with a decorative pattern.

Another object of the present invention is to provide a sling chair that has a layer of cushioning material to increase the comfort of a person seated on the chair.

A further object of the present invention is to provide a sling chair in which the joinder between the seat and backrest and the chair frame is not readily visible so as to present a pleasing, finished appearance.

Yet another object of the present invention is to provide a lightweight recreational chair having padding and a surface which may be imprinted with a decorative pattern that will withstand the rigors of recreational use.

SUMMARY OF THE INVENTION

The above and other objects of the present invention are achieved in the embodiments described herein by the provision of a chair having a skeletal frame and a pliable seat and backrest having first and second superposed and interconnected fabrics. The first and second fabrics have looped fabric portions that define opposite side edges of the fabrics. The skeletal frame has a pair of elongate members forming supporting means for the seat and bracket. Each elongate member has a lengthwise extending passageway with a longitudinal slot for receiving a looped fabric portion of the first fabric of the seat and backrest. The elongate flexible members extend through the looped fabric portions of the first fabric so that the seat and backrest are thereby connected to the skeletal frame of the chair. The looped fabric portions of the second fabric are positioned to overlie the elongate members and also the looped fabric portions of the first fabric which are positioned in the passageways in the elongate members, whereby the appearance of the chair is enhanced. In a preferred embodiment, the first fabric substantially supports the tensile forces imposed on the seat and backrest by the weight of a person seated in the chair. Also in a preferred embodiment, the second fabric has a closer weave construction than the first fabric so that it may have a printed pattern thereon.

BRIEF DESCRIPTION OF THE DRAWINGS

The foregoing and other objects, advantages and features of the invention, and the manner in which the same are accomplished, will become more readily apparent upon consideration of the following detailed description of the invention taken in conjunction with the accompanying drawings which illustrate preferred and exemplary embodiments, and wherein.

DESCRIPTION OF THE PREFERRED EMBODIMENTS

Figure 1:
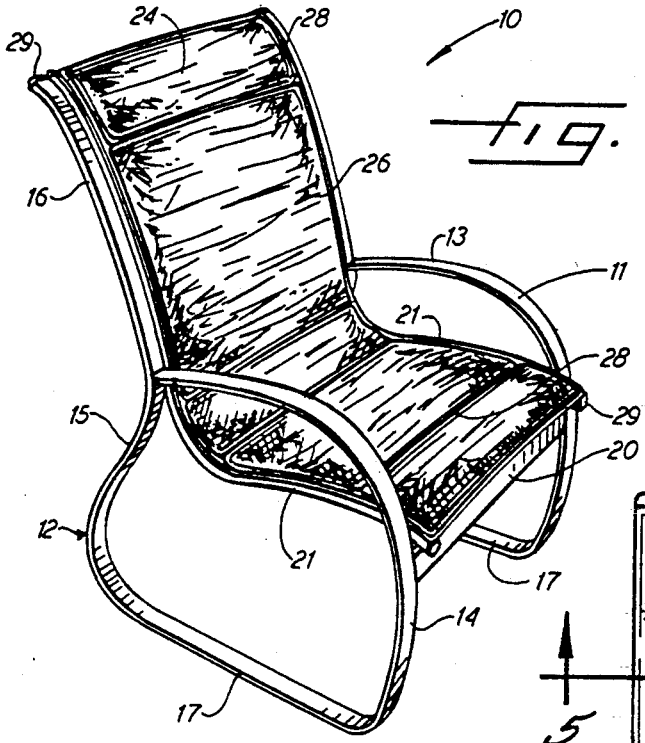
FIG. 1 is a perspective view of one preferred embodiment of a cushioned sling chair made in accordance with the present invention.

Referring now to the drawings, FIG. 1 illustrates a cushioned sling chair designated generally at 10 which is made in accordance with the present invention. The cushioned sling chair 10 has a skeletal frame 11 formed of rigid materials. In a preferred embodiment, the frame 11 is formed of extruded metal tubing such as aluminum which is bent and welded or otherwise fastened to form the frame 11.

The frame 11 may include side portions 12 that define armrests 13, front and rear legs 14 and 15, respectively, and an upper back support 16. The side portions 12 may also include bottom runners 17 for improved support and stability; however, the front and rear legs 14 and 15 may terminate independently without the interconnecting bottom runners 17.

Figure 2:
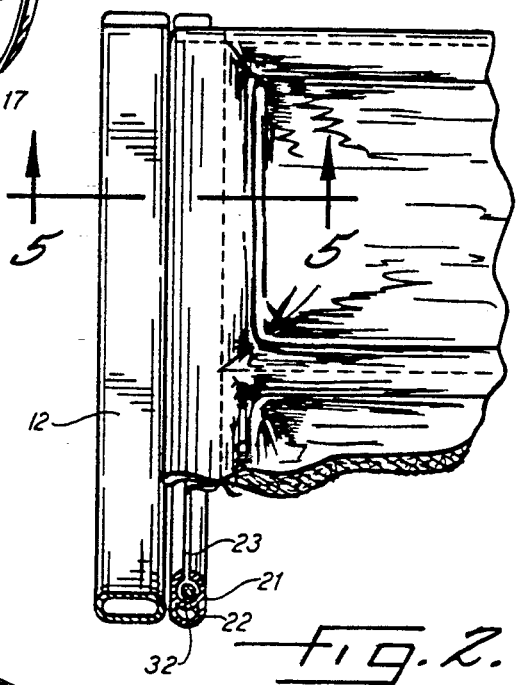
FIG. 2 is a partial elevational view of padded sling chair made in accordance with the present invention and illustrating the attachment of the padded sling to the chair frame.
Figure 5:
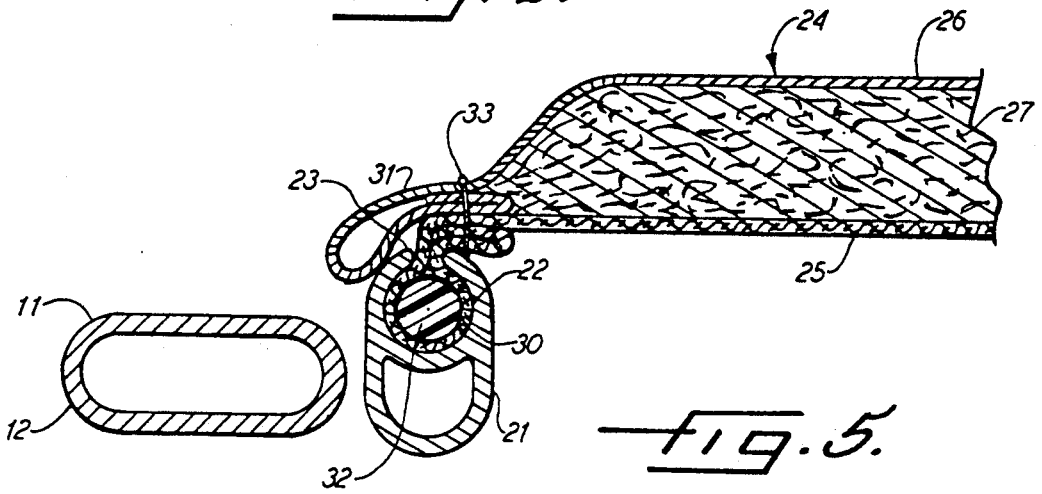
FIG. 5 is an enlarged, partial sectional view taken along line 5—5 of FIG. 2.

The side portions 12 are interconnected by lateral braces 20. Also, elongate members 21 are connected to the interior edges of the skeletal frame 11. As best shown in FIGS. 2 and 5, the elongate members 21 have lengthwise extending passageways 22 and longitudinal slots 23 formed therein. As shown in FIG. 1, the elongate members 21 with passageways 22 and slots 23 extend adjacent the opposing side portions 12 of the skeletal frame 11 so as to define a seating area between the members 21. Caps 29 are positioned to overlie and cover each end of each elongate members 21 and each open end of the tubing in the frame 11.

Figure 4:
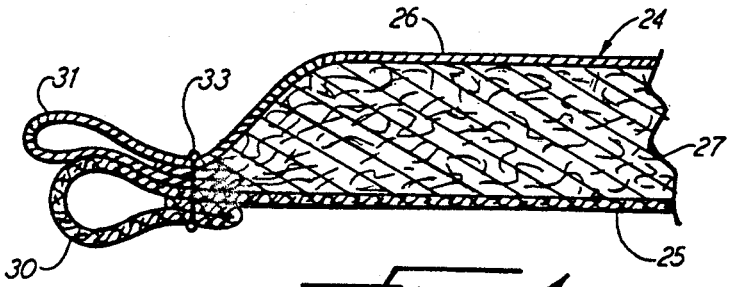
FIG. 4 is an enlarged, partial sectional view taken along line 4—4 of FIG. 3.

As shown in FIGS. 1 and 2, a pliable seat and backrest portion 24 is formed as a unitary member that is attached to the elongate members 21 and is thereby suspended from the skeletal frame 11. FIGS. 4 and 5 show that the seat and backrest portion 24 includes a first fabric 25 and a second fabric 26 which are superposed and interconnected. A batt of cushioning material 27 is positioned between the fabrics 25 and 26 for added comfort to an occupant of the padded sling chair 10.

The first fabric layer 25 is preferably made from a relatively heavy fabric that is capable of supporting the tensile forces that result when a person sits in the chair. In a preferred embodiment, the first fabric layer 25 is woven from a blend of polymeric fibers, such as vinyl and acrylic monofilament yarns. In a particularly preferred embodiment, the first fabric 25 is made of an Elbertex TM fabric made of a blend of approximately two-thirds vinyl fibers and one-third acrylic fibers. Also in a preferred embodiment, the second fabric 26 is made of a relatively lighter weight fabric, such as a fabric woven from polymeric fibers such as a blend of approximately two-thirds acrylic fibers and one-third polyester fibers. It is particularly advantageous to use a relatively lighter weight fabric for the second fabric 26 that is suitable for being imprinted with a decorative design and which has a smooth surface that is comfortable for a person to sit on.

The cushioning material 27 that is positioned between the first and second fabric layers 25 and 26 may be made of a batt of fibrous material. In a preferred embodiment, a polyester fiber batt comprised of entangled 1.81 ounce polyester fibers is used.

Figure 3:
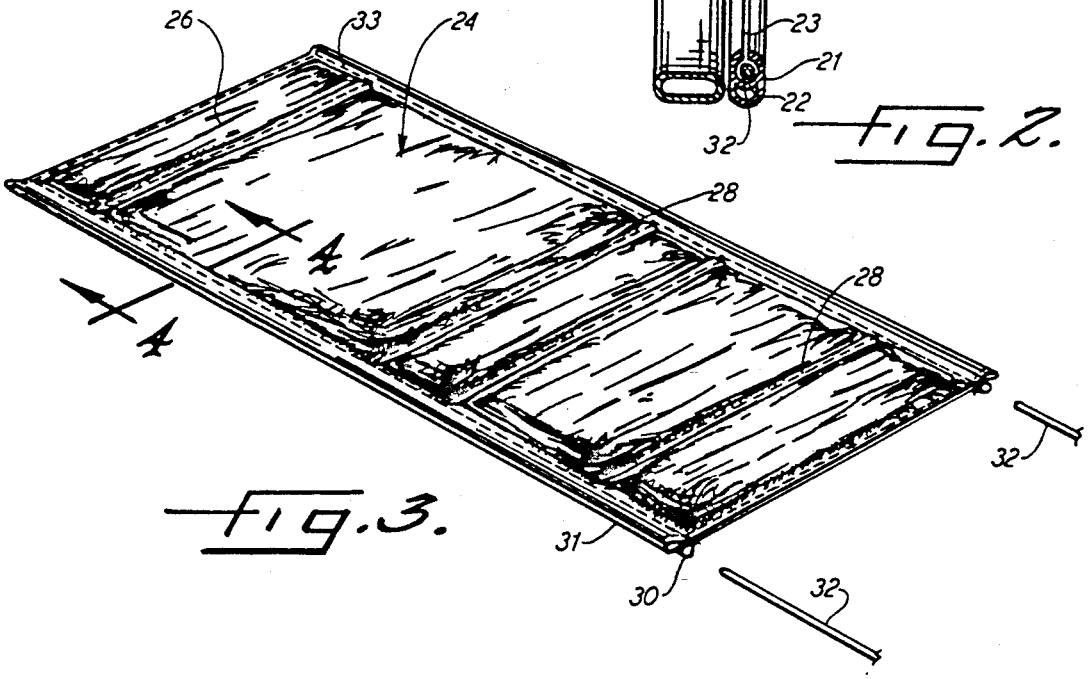
FIG. 3 is a perspective view of a padded sling seat and backrest made in accordance with the present invention which is not installed in a chair frame.

As shown in FIG. 4 and 5, the first fabric 25 and second fabric 26 have looped fabric portions 30 and 31, respectively, defining opposite side edges thereof, as best shown in FIGS. 3 and 4. The looped fabric portion 30 is of an appropriate size to receive an elongate flexible member 32. The flexible members 32 extend through the looped fabric portion 30 along the entire length of the seat and backrest 24. As shown in FIGS. 2 and 5, the elongate flexible members 32 within the looped fabric portions 30 are of a size greater than the longitudinal slots 23 formed in the elongate members 21. The longitudinal slots 23 are of sufficient size to permit passage of the multiple layers of the first fabric 25 so that the loops 30 and 31 may be formed by hemming the fabrics 25 and 26 with stitching 33. Thus, the seat and backrest 24 are connected by the engagement of the elongate flexible members 32 and the looped fabric portions within the lengthwise extending passageways 22 of the elongate members 21 adjacent each side portion 12 of the skeletal frame 12. The seat and backrest 24 are thereby connected to the skeletal frame 11 of the chair 10.

As shown in FIGS. 2 and 5, the looped fabric portions 31 that are formed in the second fabric layer 26 are positioned to overlie the elongate members 21 and the looped fabric portions 30 of the first fabric 25. Thus, the positioning of the looped fabric portions 31 enhances the appearance of the chair 10 by obscuring the elongate members 21 and the passage of the looped fabric portions 30 into the slots 23.

As shown in FIG. 3, the seat and backrest 24 may include lateral stitching 28 at a plurality of intermediate positions to affix and stabilize the cushioning material 27 within the first and second fabrics 25 and 26 and to secure the fabrics 26 and 27 to each other.

Figure 6:
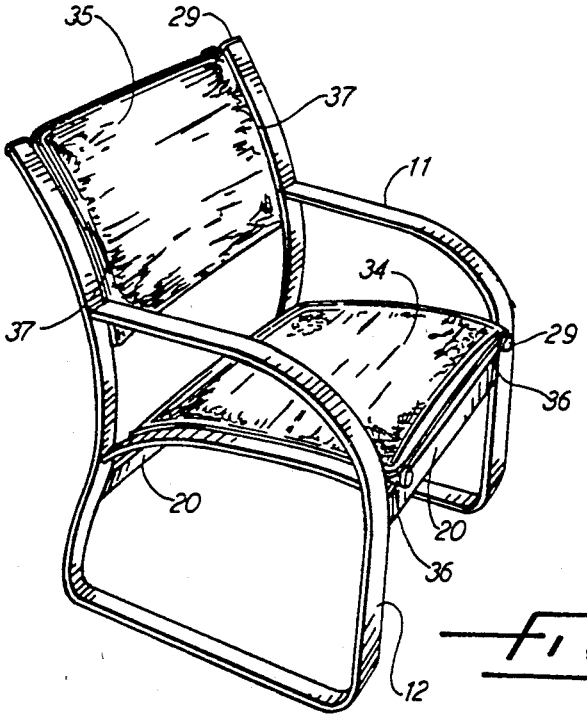
FIG. 6 is a perspective view of another preferred embodiment of a cushioned sling chair made in accordance with the present invention.

An alternative embodiment of the present invention, as shown in FIG. 6, has a skeletal frame 11 which supports a seat portion 34 and backrest portion 35 which are formed as separate members. The construction of the seat and backrest portions 34 and 35 are identical to the unitary seat and backrest portion 24 illustrated in FIG. 3 except that each portion is relatively smaller. The seat portion 34 and backrest portion 35 are connected to the skeletal frame 11 by bottom elongate members 36 and upper elongate members 37 in a fashion similar to that which is described hereinabove. The ends of the members 36 and 37 are closed by caps 29.

In the drawings and specification, there have been disclosed typical preferred embodiments of the invention. Although specific terms have been employed, they have been used in a generic and descriptive sense only and not for purposes of limitation, the scope of the invention being set forth in the following claims.

What is claimed is:

1. A pliable seat and backrest portion for a chair, comprising:

first and second superposed fabrics, said first fabric being of heavier weight than said second fabric for supporting tensile loads, and said second fabric being of lighter weight than said load-bearing first fabric and being suitable for having a decorative appearance and smooth surface;

a batt of cushioning material between said fabrics;

looped portions in said first fabric and looped portions in said second fabric defining opposite side edges of said first fabric, and an elongate flexible member received within each said looped first fabric portion, such that said looped first fabric portions may be secured to slots in a chair frame to retain said seat and backrest portion tightly stretched across the frame, and said looped second fabric portions overlying said looped first fabric portions, whereby said second looped fabric portions obscure said looped first fabric portions when said seat and backrest portion is installed on a chair frame;

stitching at intermediate positions in said seat and backrest portion to secure said first and second fabrics to each other and to stabilize said batt of cushioning material; and said first and second fabrics being woven of polymeric fibers, whereby said first fabric is woven of a blend of vinyl and acrylic monofilament fibers and wherein said second fabric is woven of a blend of polyester and acrylic fibers.

2. A pliable seat and backrest portion according to claim 1 wherein said first fabric is approximately one-third acrylic fibers and two-thirds vinyl fibers and wherein said second fabric is approximately one-third polyester fibers and two-thirds acrylic fibers.

3. A pliable seat and backrest portion according to claim 1 wherein said batt of cushioning material is formed of entangled polyester fibers.

4. A pliable seat and backrest portion according to claim 1 wherein said elongate flexible member has a substantially round cross sectional shape.

5. A pliable seat and backrest portion for a chair, comprising:

first and second superposed fabrics, said first fabric being of heavier weight than said second fabric for supporting tensile loads, and said second fabric being of lighter weight than said load-bearing first fabric and being suitable for having a decorative appearance and smooth surface;

a batt of cushioning material between said fabrics;

looped portions in said first fabric and looped portions in said second fabric defining opposite side edges of said first fabric, and an elongate flexible member received within each said looped first fabric portion, such that said looped first fabric portions may be secured to slots in a chair frame to retain said seat and backrest portion tightly stretched across the frame, and said looped second fabric portions overlying said looped first fabric portions, whereby said second looped fabric portions obscure said looped first fabric portions when said seat and backrest portion is installed on a chair frame;

stitching at intermediate positions in said seat and backrest portion to secure said first and second fabrics to each other and to stabilize said batt of cushioning material;

said first and second fabrics being woven of polymeric fibers;

said batt of cushioning material being formed of entangled polyester fibers;

said elongate flexible members having a substantially round cross sectional shape; and said first and second fabrics being joined along said side edges by stitching which also closes said first and second looped fabric portions.

6. A chair, comprising:

a frame having opposite side structures;

an elongate member supported by each said side structure so as to define a seating area, each said elongate member having a lengthwise extending passageway of generally uniform width and a longitudinal slot of lesser width leading to said passageway, each said slot opening generally perpendicular to said seating area;

a pliable seat and backrest portion stretched between said elongate members and being formed of first and second superposed fabrics and a batt of cushioning material between said fabrics, said first fabric being of heavier weight than said second fabric for supporting tensile forces created by a person seated in said chair, and said second fabric being of lighter weight than said load-bearing first fabric for having a decorative appearance and smooth surface;

looped portions in said first fabric and looped portions in said second fabric, each said looped first and second fabric portions defining opposite side edges of said seat and backrest portion; and an elongate flexible member encased within each said looped first fabric portion and having a width greater than said longitudinal slots, each said looped first fabric portion and enclosed elongate flexible member being retained within one said lengthwise passageway to suspend said seat and backrest portion between said elongate members;

said looped second fabric portions overlying said looped first fabric portions and said longitudinal slots so as to obscure said slots and looped first fabric portions, whereby the appearance of said chair is enhanced.

7. A chair as defined in claim 6 wherein said second fabric is suitable for imprinting with a decorative pattern.

8. A chair as defined in claim 6 further comprising stitching at intermediate positions in said seat and backrest portion to secure said first and second fabrics to each other and to stabilize said batt of cushioning material.

9. A chair according to claim 6 wherein said elongate flexible members have a substantially round cross sectional shape.

10. A chair according to claim 6 wherein said first and second fabrics are joined along said opposite side edges by stitching which closes said first and second looped fabric portions.

11. A chair according to claim 6 wherein said first and second fabrics are woven.

12. A chair according to claim 11 wherein said first and second fabrics are made of polymeric fibers.

13. A chair according to claim 12 wherein said seat and backrest portion is a unitary member.

14. A chair according to claim 12 wherein said seat and backrest portion is formed of separate members.

15. A chair according to claim 12 wherein said batt of cushioning material is formed of entangled polyester fibers.

16. A chair according to claim 12 wherein said first fabric is a blend of vinyl and acrylic monofilament fibers.

17. A chair according to claim 16 wherein said first fabric is approximately one-third acrylic fibers and two-thirds vinyl fibers.

18. A chair according to claim 16 wherein said second fabric is a blend of polyester and acrylic fibers.

19. A chair according to claim 18 wherein said second fabric is approximately one-third polyester fibers and two-thirds acrylic fibers.

* * * * *

UNITED STATES PATENT AND TRADEMARK OFFICE

CERTIFICATE OF CORRECTION

PATENT NO. : 5,318,348

DATED : June 7, 1994

INVENTOR(S) : Stephen C. Hess

It is certified that error appears in the above-identified patent and that said Letters Patent is hereby corrected as shown below:

Col. 2, line 68, "bracket" should be --backrest--

Col. 4, line 4, "members" should be --member--

Col. 5, line 50, "whereby" should be --wherein--

Col. 6, line 28, "members" should be --member--

Signed and Sealed this

Thirtieth Day of August, 1994

*Attest:*

Bruce Lehman

BRUCE LEHMAN

*Attesting Officer*

*Commissioner of Patents and Trademarks*